US006688488B2

(12) United States Patent
Bailey

(10) Patent No.: US 6,688,488 B2
(45) Date of Patent: Feb. 10, 2004

(54) BLISTER SPRING FOR POP-UP SHEET MATERIAL DISPENSER

(75) Inventor: Dale O. Bailey, White Bear Lake, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 51 days.

(21) Appl. No.: 10/096,757

(22) Filed: Mar. 12, 2002

(65) Prior Publication Data

US 2003/0173372 A1 Sep. 18, 2003

(51) Int. Cl.[7] ..... B65H 1/00

(52) U.S. Cl. ..... 221/45; 221/47; 221/55; 221/63

(58) Field of Search ..... 221/33, 45, 47, 221/55, 63

(56) References Cited

U.S. PATENT DOCUMENTS

| | | | | |
|---|---|---|---|---|
| 4,416,392 A | | 11/1983 | Smith | 221/45 |
| 4,586,631 A | | 5/1986 | Loder | 221/58 |
| 4,653,666 A | | 3/1987 | Mertens | 221/45 |
| 4,770,320 A | * | 9/1988 | Miles et al. | 221/33 |
| 4,781,306 A | | 11/1988 | Smith | 221/33 |
| 4,993,590 A | | 2/1991 | Windorski | 221/46 |
| 5,080,254 A | * | 1/1992 | Feer | 221/33 |
| 5,080,255 A | * | 1/1992 | Windorski | 221/45 |
| 5,165,570 A | | 11/1992 | Windorski | 221/46 |
| 5,518,144 A | * | 5/1996 | Samuelson et al. | 221/33 |
| 5,540,354 A | | 7/1996 | Annand | |
| 5,671,866 A | | 9/1997 | Bodzian | 221/45 |
| 6,123,221 A | * | 9/2000 | Simpson | 221/33 |
| 6,514,585 B1 | * | 2/2003 | Pearson et al. | 221/33 X |

FOREIGN PATENT DOCUMENTS

| | | |
|---|---|---|
| GB | 1085560 | 10/1967 |
| GB | 2 041 882 | 9/1980 |

* cited by examiner

*Primary Examiner*—David H. Bollinger
(74) *Attorney, Agent, or Firm*—Carolyn V. Peters

(57) ABSTRACT

A package for dispensing individual sheets of material from a stack includes a base and a compartment with side walls connected to the base and a cover connected to the side walls for holding the stack of sheet material. The cover includes an opening that is configured to define a pair of flanges on either side of the opening. The flanges are formed to be angularly displaced relative to the cover toward the base to bias the stack of sheet material toward the base.

14 Claims, 4 Drawing Sheets

BLISTER SPRING FOR POP-UP SHEET MATERIAL DISPENSER

BACKGROUND OF THE INVENTION

The present invention relates to an improved package for dispensing individual sheets of material from a stack. In particular the present invention relates to an improvement in packages for individually dispensing sheet material formed in a stack and adhered together with a peelable adhesive layer along alternating opposing edges, e.g., in a Z-fold manner, such that one sheet of the material can be removed from the package and separated from an adjacent sheet of material without withdrawing the adjacent sheet of material.

An example of known packaging for dispensing such sheet material is depicted in FIGS. 1 and 2. As shown in FIG. 1, the package 10 includes a base 12 and a compartment 14 (a.k.a. a blister) attached to base 12. Compartment 14 is designed to contain the stack of sheet material and allow removal of individual sheets from the stack. The compartment 14 includes side walls 16, which are dimensioned to accommodate a stack of sheet material, and a cover 18 connected to the side walls 16 about the periphery of the compartment 14 to contain the stack of sheet material. The cover 18 is configured to define an opening 20 that extends across the cover 18 through which individual sheets of material can be removed from the stack. The cover also includes a pair of slits 22 at opposite ends of and transverse to opening 20 to facilitate in the removal of an individual sheet of material. The opening 20 and slits 22 thereby define a pair of opposing flanges 24 and 26. Flanges 24 and 26 each include one or more raised portions 28, which are designed to support an individual sheet of material above the cover 18 and thereby facilitate removal of the sheet.

FIG. 2, which is a cross-sectional view of FIG. 1 taken along line 2—2, best shows the manner in which package 10 functions to dispense individual sheets of material. As shown in FIG. 2, a stack of sheet material 30 is contained within compartment 14 when compartment 14 is connected to base 12. An individual sheet of material 32 extends through opening 20 and is supported above cover 18 by raised portions 28. As is shown in FIG. 2, a biasing means is positioned within the package between the base 12 and the stack of sheet material 30. Biasing means 34 is designed to maintain the top of the stack in contact with an inner surface of cover 18 as individual sheets are removed from the stack. Sufficient contact between the top of the stack and the cover is necessary to ensure that the coefficient of friction between the inner surface of cover 18 and the top-most sheet 36 in the stack 30 within the compartment 14 is greater than that of the peelable adhesive that interconnects sheet 36 with sheet 32, as sheet 32 is removed. An insufficient contact between the top of the stack and the cover can result in multiple sheet dispensing. A package constructed as depicted in FIGS. 1 and 2 thus was designed to allow a sheet of material from a stack of interconnected sheets of material to be dispensed one at a time. In the known package of FIGS. 1 and 2, the biasing means 34 is constructed of a folded paper board material, which can be compromised in its biasing ability by conditions such as high humidity or prolonged periods of compression. Also, the use of such biasing means complicates assembly of the package (e.g., positioning and aligning biasing means between the base and the stack of material) and constitutes an additional packaging cost. The present invention is an improved package for dispensing individual sheets of material from a stack without the need for a separate biasing means between the stack of material and the base of the package.

BRIEF SUMMARY OF THE INVENTION

The present invention is directed to a package for dispensing pop-up sheet material. The package comprises a compartment attached to a base, the compartment having side walls extending from the base and a cover connected to the side walls for containing the sheet material. An opening is provided in the cover to allow individual sheets to be dispensed. A pair of movable flanges are located on opposite sides of the opening, and are formed to be angularly displaced relative to the cover toward the base to thereby apply a biasing force against the sheet material in the compartment.

While the above-identified drawing figures set forth preferred embodiments of the invention, other embodiments are also contemplated, as noted in the discussion. In all cases, this disclosure presents the present invention by way of representation and not limitation. It should be understood that numerous other modifications and embodiments can be devised by those skilled in the art which fall within the scope and spirit of the principles of this invention. It should be specifically noted that the figures have not been drawn to scale as it has been necessary to enlarge certain portions for clarity.

DETAILED DESCRIPTION

Figure 1:
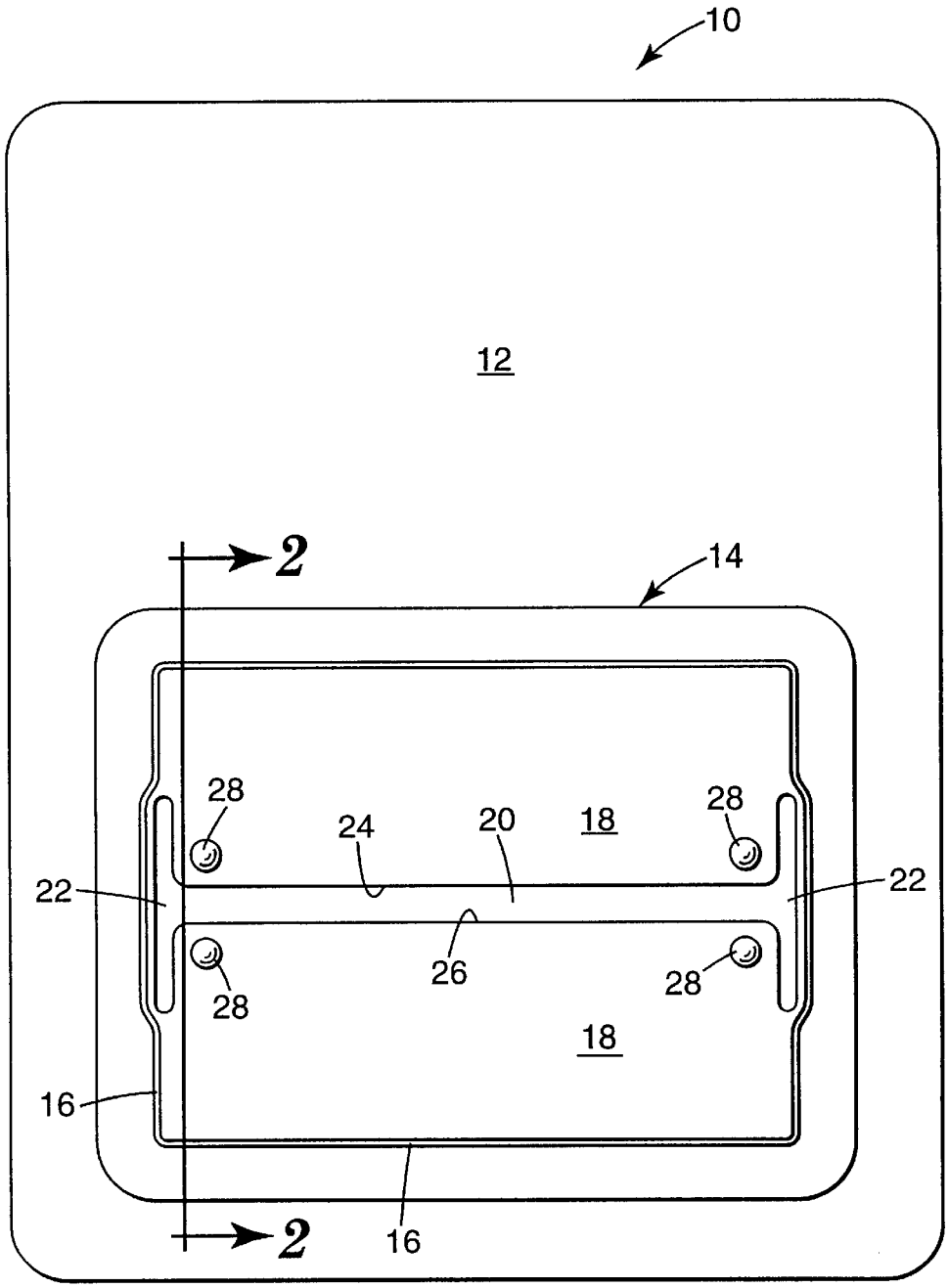
Fig. 1 PRIOR ART
FIG. 1 is a top view of a package of the prior art.
Figure 2:
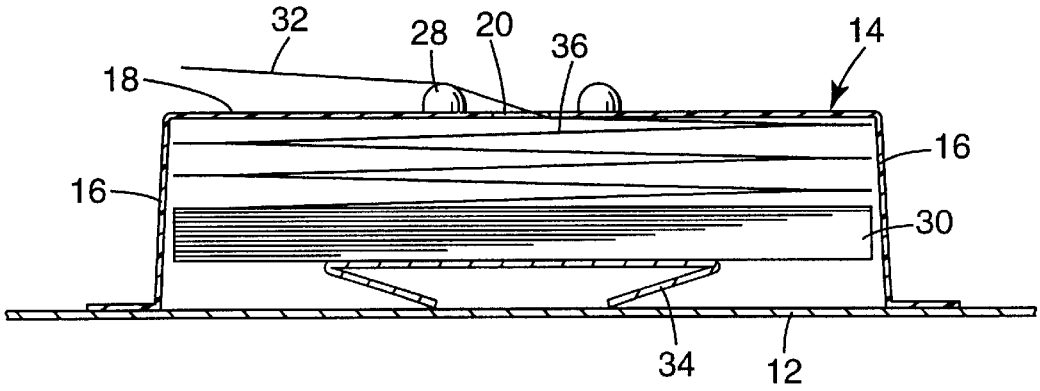
Fig. 2 PRIOR ART
FIG. 2 is a cross-sectional view of FIG. 1 taken along line 2—2.
Figure 3:
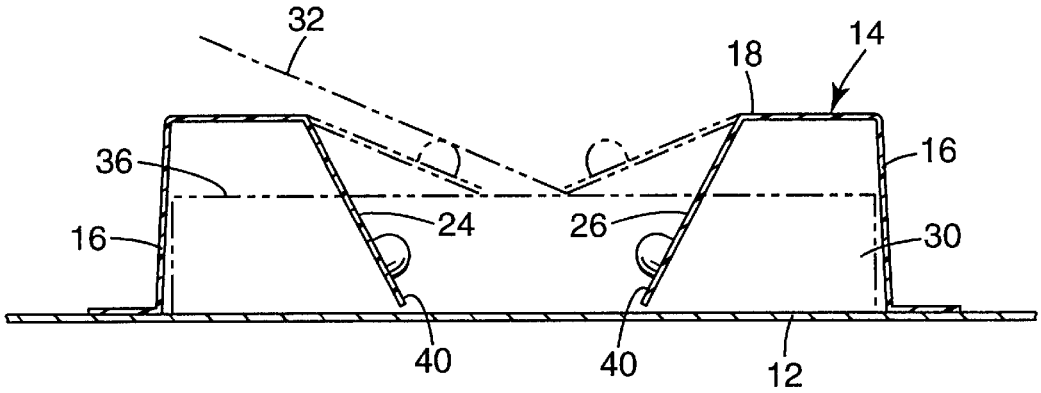
FIG. 3 is a cross-sectional view of the inventive modification to the package of FIG. 1.

The present invention comprises an improvement to the prior art package shown in FIGS. 1 and 2. The principal improvement comprises elimination of a biasing means between the base and the stack of material that applies a biasing force against the bottom of the stack of material. FIG. 3 shows a cross-sectional view of the inventive improvement to the package of FIG. 1. As shown in FIG. 3, flanges 24 and 26 of cover 18 are formed to be angularly displaced toward the base 12. Flanges 24 and 26 are dimensioned to ensure that the opposing edges 40 extend substantially to the base 12 when the compartment 14 is empty. As further shown in phantom in FIG. 3, flanges 24 and 26 flex and rotate away from base 12 when a stack of sheet material is contained within compartment 14. By selecting a suitably resilient material for compartment 14, flanges 24 and 26 serve as means for biasing the cover 18 of compartment 14 against the top of the stack of sheet material 30, which in turn holds the stack of sheet material against the base 12. The biasing force of flanges 24 and 26 is sufficient to allow sheet 32 to be removed from the compartment and separated from the stack 30 and yet to hold the subsequent sheet 36 (i.e., the next top-most sheet in the stack) in a manner described relative to sheet 32 in FIG. 2.

In one embodiment, compartment 14 is formed from a polymer material. By way of a non-limiting example, a package of the present invention was constructed with the walls 16 and cover 18 of the compartment 14 formed of polyvinyl chloride (PVC) having a wall thickness of 15 mil. With the flanges 24 and 26 formed at an initial angle of approximately 45 degrees relative to cover 18, individual sheets of a stack of 50 sheets of material interconnected in a Z-fold manner by a pressure-sensitive repositionable adhesive were dispensed one at a time, without any multiple sheet dispensing. Flanges 24 and 26 retain sufficient resilient force against the top of the stack to retain the sheet of material immediately subsequent to the sheet being dispensed, even as the stack of sheet material is reduced to zero.

Figure 4:
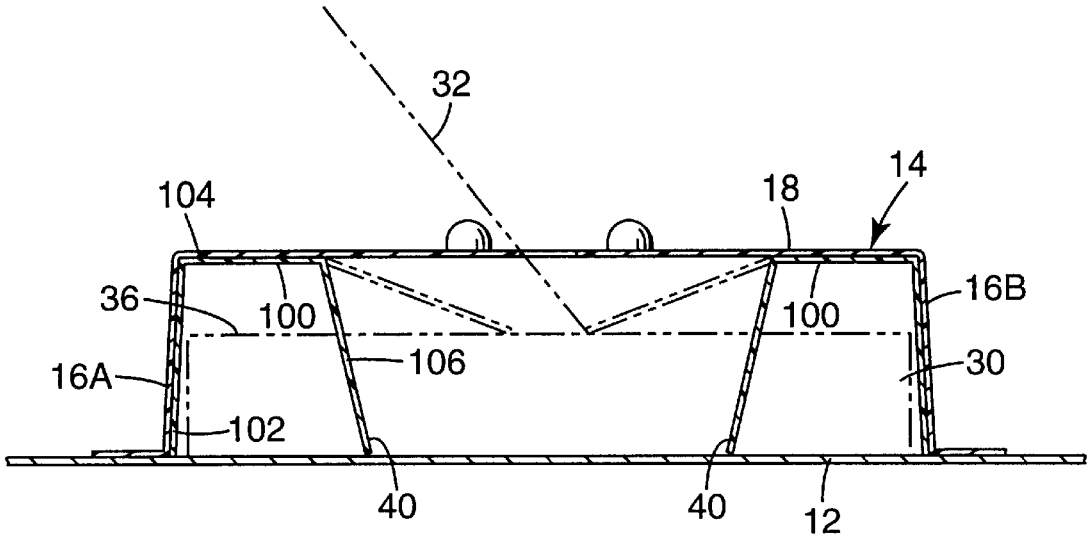
FIG. 4 is a cross-sectional view of a first alternative embodiment of the present invention.

FIG. 4 is a cross-sectional view of a first alternative embodiment of the present invention. As shown in FIG. 4, a downward biasing force applied to the top of the stack of sheet material can be accomplished by modifying the prior art package of FIGS. 1–2 to include a pair of biasing devices 100 within compartment 14. Each biasing device 100 includes a first section 102, a second section 104, and a flange section 106. Each first section 102 generally corresponds in dimension and orientation with side walls 16A and 16B, and is connected thereto by, for example, an adhesive. Each second section 104 has a length corresponding to first section 102, and generally corresponds in orientation with cover 18. Flange sections 106 are formed at an angle relative to second sections 104 so as to provide a biasing force against the top of the stack of sheet material 30. Biasing devices 100 are formed from a flexible polymer material, and like flanges 24, 26 of FIG. 3, flange sections 106 apply a biasing force to the top of a stack of sheet material and rotate toward base 12 to maintain such a biasing force as the stack is depleted.

Figure 5:
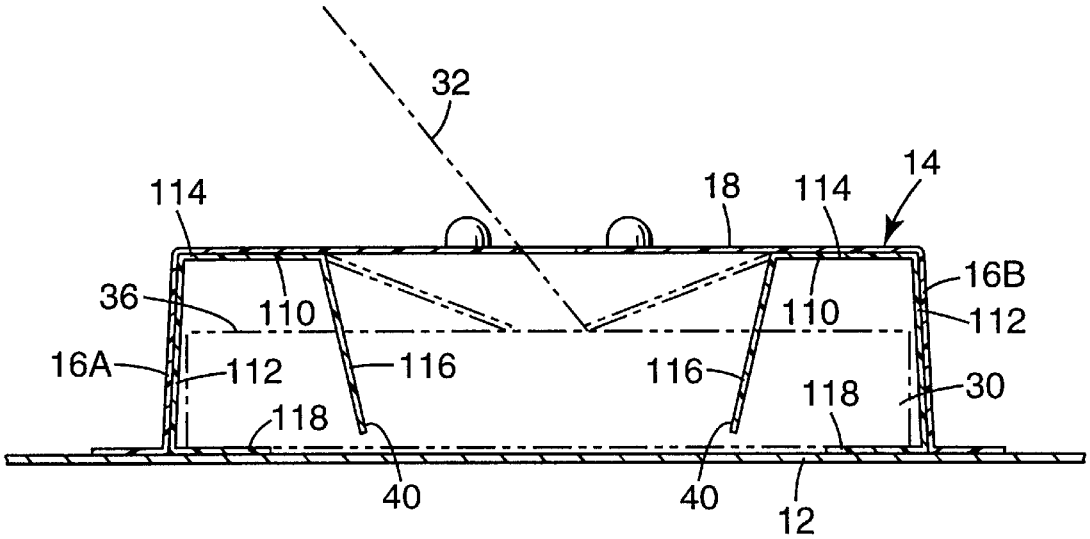
FIG. 5 is a cross-sectional view of a second alternative embodiment of the present invention.
Figure 6:
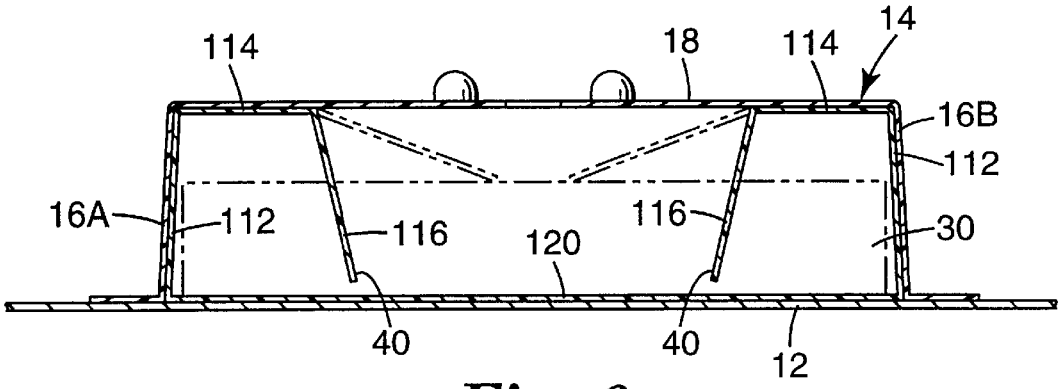
FIG. 6 is a cross-sectional view of a third alternative embodiment of the present invention.

FIG. 5 shows a cross-sectional view of a third embodiment of the present invention. The embodiment of FIG. 5, like the embodiment of FIG. 4, is directed to a pair of biasing devices 110 positioned within compartment 14. Like biasing devices 100 of FIG. 4, each biasing device 110 includes a first section 112, which corresponds to side walls 16A and 16B, a second section 114, which corresponds to cover 18 and a flange section 116. Biasing devices 110 differ from the embodiment of FIG. 4, however, in that each first section 112 is not connected to side walls 16A and 16B. Further, to ensure that biasing devices 110 are maintained in position within compartment 14, each biasing devices 110 is provided with a base section 118 which extends transversely from first section 112 along base 12. Sections 112, 114 and 118 of biasing device 110 thereby envelope end portions of the stack of sheet material, and the stack of sheet material holds biasing devices 110 relative to side walls 16A and 16B and base 12. As shown in FIG. 6, base sections 118 may be formed to extend completely beneath the stack of sheet material 30 and thereby form a single contiguous base section 120.

The package of the present invention permits successfully dispensing of individual sheets from a stack of sheet material by providing flanges which are formed to apply a force against the top of a stack of sheet material with sufficient friction of the leading edge of the flanges against the sheet material which is greater than the force required to remove the top-most sheet from the container and separate it from the subsequent sheet in the stack. It will be appreciated by those in the art that the force of the flanges and friction of the leading edge of the flanges can be adapted to accommodate varying dimensions of the stack of sheet material, the surface properties of the sheet material, and the adhesion properties of the adhesive interconnecting the sheets. For example, the holding properties of the flanges can be varied by varying the size and angle of the flanges, varying the material and/or the thickness of the material forming the cover, varying the width of the opening, and/or by varying the surface area of the leading edge of the flange.

Although the present invention has been described with reference to preferred embodiments, workers skilled in the art will recognize that changes may be made in form and detail without departing from the spirit and scope of the invention.

What is claimed is:

1. A package for dispensing pop-up sheet material comprising:

a base;

a compartment attached to the base, the compartment comprising a plurality of interconnected side walls extending from and transverse to the base and a cover connected to the side walls, the cover configured to define an opening which extends essentially between two opposing edges of the compartment, the opening thereby defining opposing flanges of the cover, the cover configured to allow movement of the flange relative to the cover;

wherein the flanges are angularly displaced relative to the cover toward the base; and wherein the flanges are angularly displaced sufficient to substantially extend to the base.

2. The package of claim 1 wherein the compartment is formed from a polymeric material.

3. The package of claim 1 wherein flanges are angularly displaced approximately 45 degrees relative to the cover.

4. A dispensing package comprising:

a base;

a compartment attached to the base, the compartment comprising a plurality of interconnected side walls extending from and transverse to the base and a cover connected to the side walls, the cover configured to define an opening which extends essentially between two opposing edges of the compartment, the compartment containing a stack of sheet material comprised of multiple sheets adhered together with a peelable adhesive layer along alternating opposing edges of each adjacent sheet; and a pair of flexible flanges positioned on opposite sides of the opening for applying a biasing force against a top of the pop-up sheet material wherein the flanges are formed at an angle relative to the cover.

5. The package of claim 4 wherein the flanges are formed at an angle relative to the cover.

6. The package of claim 4 wherein the pair of flanges are contiguous with the cover.

7. The package of claim 4 wherein the pair of flanges are positioned within the compartment, each pair of flanges further comprising a first section associated with one of opposing side walls of the compartment.

8. The package of claim 7 wherein the first section of each pair of flanges is connected to each one of the opposing side walls.

9. The package of claim 7 wherein each pair of flanges further comprises a second section connected to the first section, each second section extending transverse to the respective first section adjacent to the base, wherein the pop-up sheet material is positioned within the compartment above each of the second sections and between each of the first sections.

10. The package of claim 9 wherein the second sections comprise a contiguous section that extends between the first sections.

11. A dispensing package comprising:

a base;

a compartment attached to the base, the compartment comprising a plurality of interconnected side walls extending from the base and a cover connected to the side walls;

a longitudinal opening disposed in the cover;

a stack of sheet material comprised of multiple sheets adhered together with a peelable adhesive layer along alternating opposing edges of each adjacent sheet disposed between the cover and the base; and at least two flexible flanges disposed between the cover and the base, each flange having a fixed end disposed proximate to the cover and a free end biased to extend toward the base wherein the free end of each flange is in engagement with the sheet most proximate the cover independent of the number of sheets in the stack.

12. The package of claim 11, wherein the flexible flanges are integral with the cover.

13. The package of claim 12, wherein the fixed end of each flange forms at least a portion of the longitudinal opening.

14. The package of claim 13, wherein the cover is generally planar.

* * * * *

UNITED STATES PATENT AND TRADEMARK OFFICE

CERTIFICATE OF CORRECTION

PATENT NO. : 6,688,488 B2
DATED : February 10, 2004
INVENTOR(S) : Bailey, Dale O.

It is certified that error appears in the above-identified patent and that said Letters Patent is hereby corrected as shown below:

Column 3,
Line 48, delete “envelope” and insert in place thereof -- envelop --.

Signed and Sealed this

Twenty-second Day of June, 2004

JON W. DUDAS
*Acting Director of the United States Patent and Trademark Office*